US007721394B2

(12) United States Patent
Snyder

(10) Patent No.: US 7,721,394 B2
(45) Date of Patent: May 25, 2010

(54) BUTTON TOOL

(75) Inventor: Darryl L. Snyder, Canton, OH (US)

(73) Assignee: Snyder National Corporation, Canton, OH (US)

( * ) Notice: Subject to any disclaimer, the term of this patent is extended or adjusted under 35 U.S.C. 154(b) by 591 days.

(21) Appl. No.: 11/586,812

(22) Filed: Oct. 26, 2006

(65) Prior Publication Data

US 2007/0119018 A1 May 31, 2007

Related U.S. Application Data

(60) Provisional application No. 60/731,589, filed on Oct. 28, 2005.

(51) Int. Cl.
*A47G 25/92* (2006.01)

(52) U.S. Cl. ..... 24/40

(58) Field of Classification Search ..... None
See application file for complete search history.

(56) References Cited

U.S. PATENT DOCUMENTS

| | | | | | |
|---|---|---|---|---|---|
| 68,361 | A | * | 9/1867 | Goldthwait | 24/40 |
| 215,612 | A | | 5/1879 | Howland | |
| 240,632 | A | | 4/1881 | Adamson | |
| 319,015 | A | | 6/1885 | Paike | |
| 322,284 | A | | 7/1885 | Havell | |
| 339,055 | A | | 3/1886 | Henderson | |
| 413,314 | A | | 10/1889 | Betzel | |
| 438,751 | A | | 10/1890 | Hodge | |
| D25,602 | S | | 6/1896 | Sommer | |
| 579,262 | A | | 3/1897 | Esterly | |
| D27,500 | S | | 8/1897 | Clark | |
| D32,524 | S | | 4/1900 | Spencer | |
| 1,084,399 | A | * | 1/1914 | Collins | 24/40 |
| D49,166 | S | | 6/1916 | Pietrowski | |
| 1,197,358 | A | | 9/1916 | Eschenbrenner | |
| 1,291,563 | A | | 1/1919 | Laughlin | |
| 1,469,437 | A | | 10/1923 | Fredrickson | |
| 2,912,733 | A | | 11/1959 | Layman | |
| 3,678,712 | A | | 7/1972 | Singleton | |
| 3,683,459 | A | | 8/1972 | Johansen | |
| D240,669 | S | | 7/1976 | Pifer | |
| 4,361,101 | A | | 11/1982 | Marsh | |
| D269,052 | S | | 5/1983 | Windsor | |
| 4,413,847 | A | | 11/1983 | Doyel | |
| D274,195 | S | | 6/1984 | Strauss | |
| D282,590 | S | | 2/1986 | Ramik | |
| 4,603,560 | A | | 8/1986 | Pietrowski | |
| D293,621 | S | | 1/1988 | Jackson | |
| D297,071 | S | | 8/1988 | Mayer | |

(Continued)

*Primary Examiner*—Jack W. Lavinder
(74) *Attorney, Agent, or Firm*—Zollinger & Burleson, Ltd.

(57) ABSTRACT

A button tool is adapted to assist a person fastening a button through a button hole. The tool includes a handle, a button hook, and a button hole spreader. In one configuration, the handle includes four longitudinally disposed ribs with one of the ribs functioning as a base rib while the other three ribs are spaced apart and disposed perpendicular to the base rib. The button hook defines a button opening and a hook opening with the button opening being larger than the hook opening. The button hole spreader is disposed between the button hook and the handle. The button hole spreader includes an abutment plate adapted to prevent the button tool from being readily pushed entirely through a button hole.

13 Claims, 3 Drawing Sheets

U.S. PATENT DOCUMENTS

| | | | | |
|---|---|---|---|---|
| 4,942,646 | A | | 7/1990 | Sebastian |
| 5,276,948 | A | | 1/1994 | Steadman |
| 5,347,688 | A | | 9/1994 | Ross |
| D384,186 | S | | 9/1997 | Teaman |
| D386,899 | S | | 12/1997 | Carroll |
| D401,389 | S | | 11/1998 | Taylor |
| D415,873 | S | * | 11/1999 | Doles ..... D2/643 |

* cited by examiner

BUTTON TOOL

CROSS REFERENCE TO RELATED APPLICATIONS

This application claims the benefit of and priority from U.S. Provisional Patent Application 60/731,589 filed 28 Oct. 2005; the disclosure of which is incorporated herein by reference.

BACKGROUND OF THE INVENTION

1. Technical Field

The present invention relates generally to hand tools and, more particularly, to hand tools designed to assist those who have trouble manipulating small objects such as the buttons and zippers on everyday clothing. Specifically, the present invention relates to a hand tool that is used to pull a button through a button hole.

2. Background Information

Shirt buttons are one of the daily frustrations for those who have difficulty manipulating small objects with one or both hands. The process of aligning a button with a button hole is difficult and time consuming for anyone who has difficulty grasping and manipulating fine objects between the thumb and finger or for those with limited eyesight. Various devices are known in the art for pulling a button through a button hole. Despite the existence of these devices, room for improvement remains in the art.

SUMMARY OF THE INVENTION

The invention provides a button tool that assists a user in pulling a button through a button hole or aligning the button with the hole so that the button may be pushed through the button hole.

In one configuration, the invention provides a button tool having a handle, a button hole spreader, and a button hook. The button hole spreader is disposed between the button hook and the handle to allow the user to spread open the button hole before pulling the button through the button hole with the button hook.

In another configuration, the invention provides a button hole spreader configuration wherein tapered fins are disposed up against an abutment plate that prevents the handle from being pushed through the button hole.

Another configuration provides dual button hooks for different-sized buttons.

In another configuration, a zipper hook is connected to the handle and may be used to hook a zipper so that it may be pulled up or down with the tool.

BRIEF DESCRIPTION OF THE DRAWINGS

The drawings are not to scale. Similar numbers refer to similar parts throughout the specification.

DETAILED DESCRIPTION OF THE PREFERRED EMBODIMENT

Figure 1:
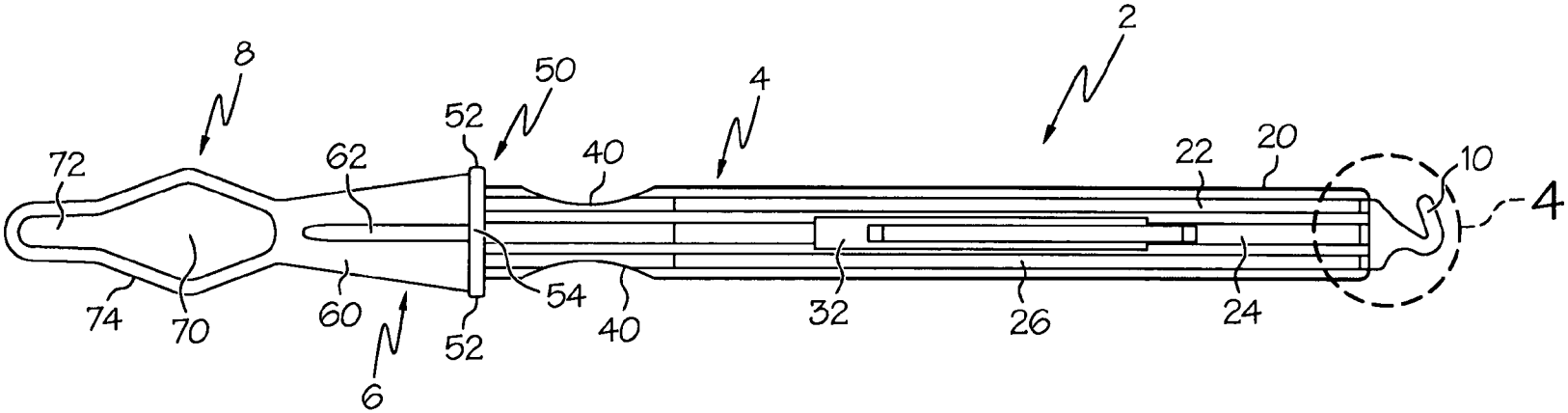
FIG. 1 is a front elevation view of the tool of the invention.
Figure 2:
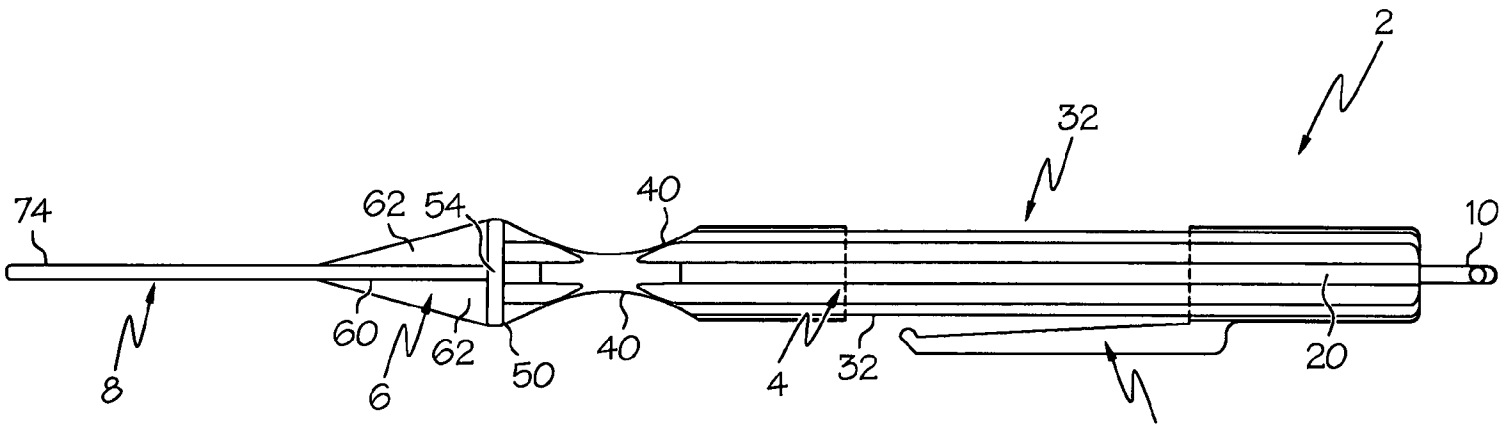
FIG. 2 is a top plan view of FIG. 1.

An exemplary configuration of the tool of the invention is indicated generally by the numeral 2 in the accompanying drawings and written description. Tool 2 generally includes a handle 4 adapted to be held and manipulated like a pen or pencil. Handle 4 has a first end and a second end. Tool 2 also includes a button hole spreader 6 and a button hook 8 disposed at the first end of handle 4. In an optional configuration, tool 2 may include a zipper hook 10 disposed at the second end of handle 4. Tool 2 may be used by a user to pull a button through a button hole by fishing button hook 8 through the button hole from the front of the button hole towards the back of the hole. The user pushes button hook 8 through the button hole until button hole spreader 6 engages the material surrounding and defining the button hole. The user may then elect to use tool 2 at this time to spread open the button hole by twisting, wiggling, or pushing button hole spreader 6 around in the button hole. The user then hooks the button to be pulled through the button hole with button hook 8. The user also may wait until the button is hooked to spread open the button hole. One benefit of the configuration of tool 2 is that tool 2 automatically spreads the button hole during the process of hooking a button because of the tapered configuration and location of button hole spreader 6. Once the button is hooked, the user pulls on tool 2 to pull the button through the button hole. This process is repeated for any other buttons needed to be fastened. In the optional configuration, the user may hook zipper pulls with hook 10 in order to pull them up or down.

Figure 3:
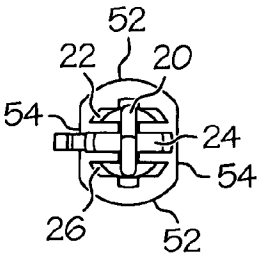
FIG. 3 is a right side view of FIG. 1.
Figure 4:
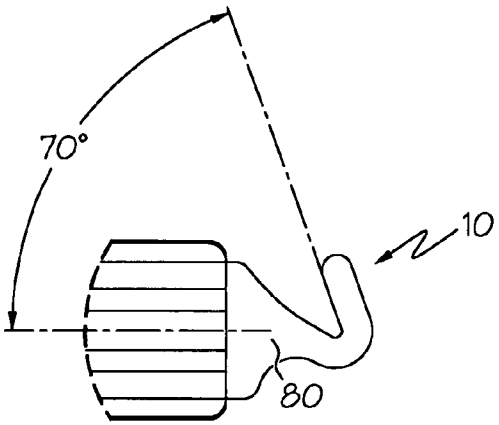
FIG. 4 is an enlarged view of the encircled portion of FIG. 1.

In one configuration, handle 4 includes four longitudinally disposed ribs 20, 22, 24, and 26. Rib 20 functions as a base rib with ribs 22, 24, and 26 being spaced from one another and disposed perpendicular to base rib 20. Rib 24 is centered with respect to rib 20 with ribs 22 and 26 disposed adjacent to, but spaced from, the ends of rib 20. The tips of each rib (as seen in FIG. 3) may be rounded or angled to create a generally rounded feel to handle 4. The spacing between ribs 20, 22, 24, and 26 provide handle 4 with desirable gripping characteristics.

A pocket clip 30 may be connected to and cantilevered from one of ribs 20, 22, 24, or 26. Clip 30 extends parallel to the ribs. Handle 4 defines a recess 32 or through opening 32 under clip 30.

Handle 4 may define an optional finger recess 40 near the first end of handle 4. Recess 40 may be formed with combined cooperating recesses in ribs 22, 24, and 26. Finger recess 40 may be used to help the user grip handle 4.

Button hole spreader 6 includes an abutment plate 50 disposed at the first end of handle 4. Abutment plate 50 is wider than handle 4 (as shown in FIG. 3) and is thus wider than ribs 20, 22, 24, and 26 (although the first end of rib 24 may be flared outwardly to smoothly merge with plate 50). Abutment plate 50 has two opposite rounded ends 52 and two opposite flat sides 54 as shown in FIG. 3. This configuration has been found to be desirable for stopping tool 2 from being pushed through button holes while providing a comfortable configuration for holding tool 2 in a pocket. The distance between flat sides 54 is 0.45 inches.

Button hole spreader 6 is generally tapered from its maximum dimension (for example—0.5 inches) at abutment plate 50 to a minimum dimension at its end distal to handle 4. In the exemplary configuration, button hole spreader 6 includes a plurality of generally triangular fins disposed at right angles to form the tapering configuration. A base fin 60 is connected to abutment plate 50 and tapers down to a distal tip that is connected to button hook 8. A pair of secondary spreader fins 62 are connected to opposite sides of base fin 60 and are disposed at right angles to base fin 60. Each secondary spreader fin 62 has a length that is less than the length of base fin 60 but each may be between 75 percent and 95 percent of the base fin length.

Button hook 8 defines a button opening 70 adapted to fit over most typical buttons and thus has a width of about 0.42 inches at its widest location. Button hook 8 also defines a hook opening 72 that merges into button opening 70. Hook opening 72 is elongated and has a width of 0.064 inches and a length of 0.331 inches. These ranges have been found to be useful for allowing button hook 8 to slide behind a button after tool 2 has been placed over top of a button. Button hook 8 has a generally thin body 74 that defines both openings 70 and 72. Body 74 may be continuous as shown in the drawings or may extend only partially around openings 70 and 72. The continuous body 74 is desirable because it prevents snags when tool 2 is placed in a pocket.

Zipper hook 10 extends from a zipper hook fin 80 connected to the second end of handle 4. Zipper hook 10 has a straight shank disposed 70 degrees with respect to the longitudinal direction of handle 4.

Figure 5:
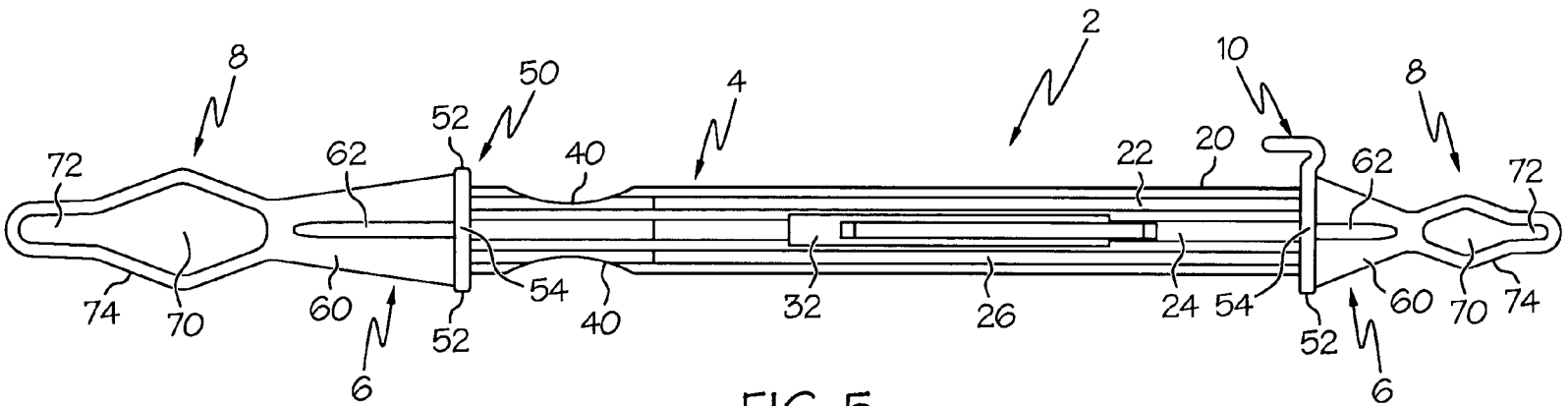
FIG. 5 is a front elevation view of an alternative configuration of the tool of the invention.

An alternative configuration of tool 2 is depicted in FIG. 5. In this alternative configuration, a second button hole spreader 6 and button hook 8 are disposed at the second end of handle 4. The second spreader 6 and hook 8 are configured for smaller buttons that are less than ⅔ the size of the buttons used with the first spreader 6 and hook 8.

Figure 6:
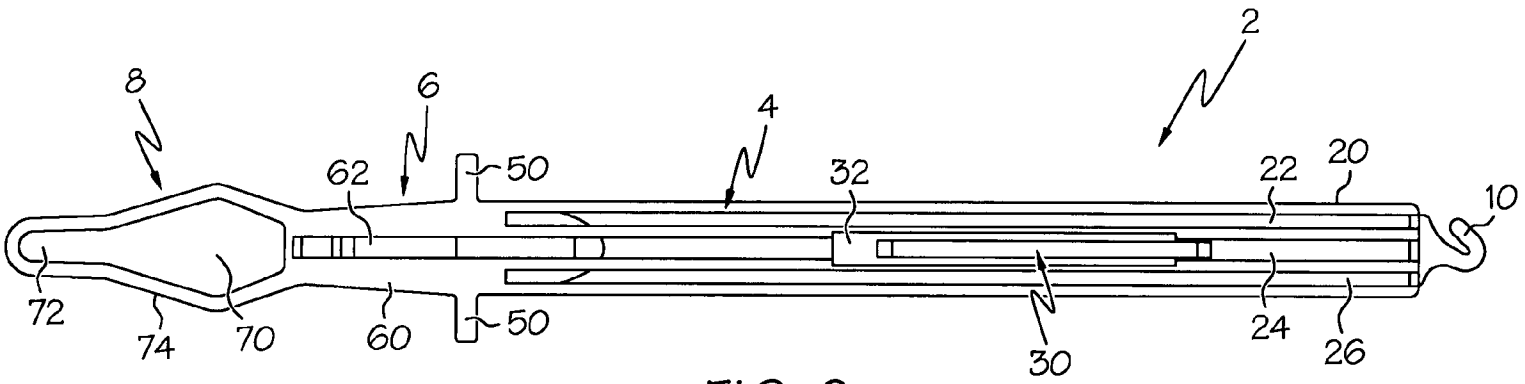
FIG. 6 is a front elevation view of an alternative configuration of the tool of the invention.
Figure 7:
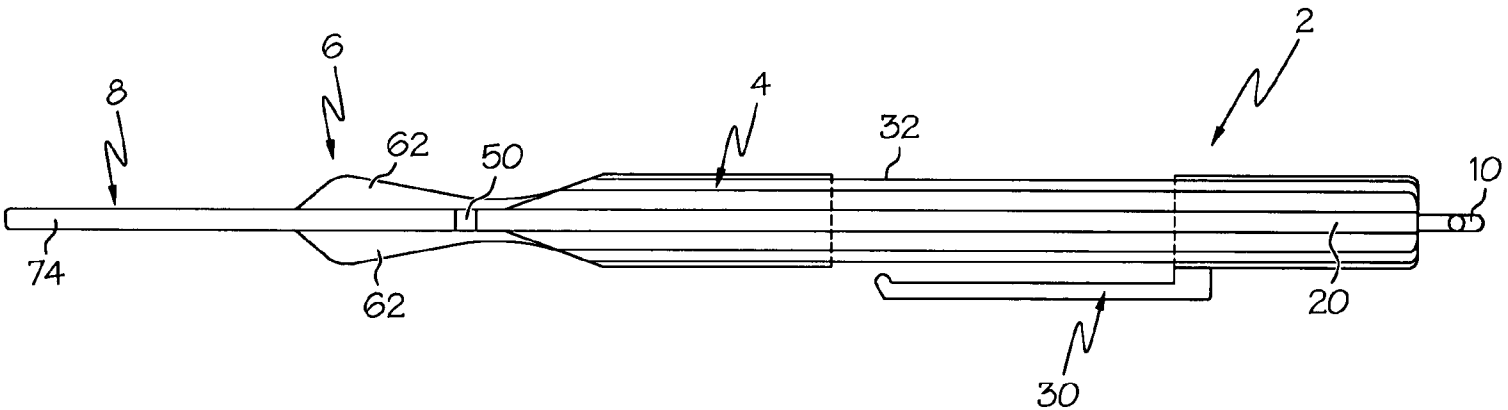
FIG. 7 is a top plan view of FIG. 6.

Another alternative configuration of tool 2 is depicted in FIGS. 6 and 7. Elements that are similar to those described above are identified with the same reference numerals in FIGS. 6 and 7. In this configuration, the abutment plate is in the form of a pair of arms 50 extending outwardly from the sides of rib 20. Each abutment arm 50 has the same thickness as rib 20. In this configuration, base fin 60 of spreader 6 is a portion of rib 20 that tapers down toward hook 8 from a maximum width at arms 50. In this configuration, secondary spreader fins 62 taper outwardly from a narrowest width at arms 50 to a widest width spaced from arms 50. Fins 62 taper back to base fin 60 from their widest width adjacent hook opening 70. Fins 62 are smoothly curved so that they will smoothly pass through the button hole. Spacing the widest location of fin 60 from the widest location of fins 62 allows the button hole to be spread open at two different times when tool 2 is used. Fins 62 will initially spread open the button hole when hook 8 is pushed through the hole. The user may then continue to push the tool into the hole to use fin 60 to open up the button hole. The user may rotate the tool if necessary. The user then hooks a button with hook 8 and pulls the tool back through the opening. The widest area of fins 62 thus spread open the button hole immediately before the hooked button is pulled through the hole.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A button tool adapted to assist a person fastening a button through a button hole; the tool comprising:

a handle;

a button hook;

the tool having a longitudinal dimension disposed from the button hook through the handle;

a tapered button hole spreader disposed between the button hook and the handle; the button hole spreader functioning to spread open a button hole before the button passes through the hole;

the handle including a pair of arms that extend outwardly in a direction substantially perpendicular to the longitudinal dimension of the handle; the pair of arms extending farther outwardly than the handle and farther outwardly than the tapered button hole spreader; and the handle including four longitudinally disposed ribs; each of the ribs being elongated in a direction parallel to the longitudinal dimension; one of the ribs functioning as a base rib with the other three ribs being spaced apart and disposed perpendicular to the base rib; the arms projecting from the base rib.

2. The tool of claim 1, wherein the button hole spreader has a maximum width and the handle has a maximum width; the maximum width of the button hole spreader being greater than the maximum width of the handle.

3. The tool of claim 1, wherein the button hook defines a button opening and a hook opening; the button opening being larger than the hook opening.

4. The tool of claim 3, wherein the handle defines a finger recess.

5. The tool of claim 1, wherein the button hole spreader includes a plurality of generally triangular fins; the triangular fins including a base fin connected and a pair of secondary spreader fins connected to opposite sides of the base fin; the secondary spreader fins being disposed at right angles to the base fin.

6. The tool of claim 5, wherein each secondary spreader fin has a length that is less than the length of base fin.

7. The tool of claim 6, wherein the length of each secondary spreader fin is between 75 percent and 95 percent of the base fin length.

8. The tool of claim 1, wherein each of the ribs defines a tip; the tips of each rib being rounded or angled to create a generally rounded feel to handle.

9. The tool of claim 1, further comprising a zipper hook connected to the handle.

10. A button tool adapted to assist a person fastening a button through a button hole; the tool comprising:

a handle;

a button hook;

the tool having a longitudinal dimension disposed from the button hook through the handle;

a button hole spreader disposed between the button hook and the handle;

the button hole spreader adapted to spread open a button hole before the button passes through the hole;

the button hole spreader includes a plurality of tapered fins; the fins including a base fin and a pair of secondary spreader fins connected to opposite sides of the base fin; the base fin being tapered from a large dimension adjacent the handle to a smaller dimension adjacent the button hook; and the secondary spreader fins tapering from a smaller dimension close to the handle to a larger dimension closer to the button hook such that the largest dimension of the secondary fins is spaced from the large dimension of the base fin.

11. The tool of claim 10, wherein the handle in includes a pair of arms that extend outwardly is a direction substantially perpendicular to the longitudinal dimension of the handle; the pair of arms extending farer outwardly than the handle and farther outwardly than the tapered button hole spreader.

12. The tool of claim 11, wherein the pair of arms are disposed at the large dimension of the base fin.

13. The tool of claim 12, wherein the base fin has a thickness and the arms have a thickness substantially equal to the thickness of the base fin.

* * * * *